United States Patent [19]

Dundas et al.

[11] Patent Number: 4,717,036

[45] Date of Patent: Jan. 5, 1988

[54] LIQUID TANK SPILLAGE CONTROL SYSTEM

[75] Inventors: Richard E. Dundas, Rockford; Gerald H. Visser, Grand Rapids, both of Mich.

[73] Assignee: Plymouth Tank of West Michigan, Inc., Grand Rapids, Mich.

[21] Appl. No.: 915,627

[22] Filed: Oct. 6, 1986

Related U.S. Application Data

[63] Continuation of Ser. No. 862,050, May 12, 1986, abandoned, which is a continuation-in-part of Ser. No. 738,592, May 28, 1985, abandoned, which is a continuation-in-part of Ser. No. 610,265, May 14, 1984, Pat. No. 4,527,708.

[51] Int. Cl.[4] ..... B65D 25/00

[52] U.S. Cl. ..... 220/18; 220/85 F; 220/85 S

[58] Field of Search ..... 220/18, 85 F, 85 S

[56] References Cited

U.S. PATENT DOCUMENTS

| | | | |
|---|---|---|---|
| 1,157,675 | 10/1915 | Caskey . | |
| 2,217,580 | 10/1940 | White | 62/1 |
| 2,327,628 | 8/1943 | Ewing | 220/85 |
| 2,382,171 | 8/1945 | Pomykala | 72/14 |
| 2,757,045 | 7/1956 | Nullet | 299/61 |
| 3,958,313 | 5/1976 | Rossoborough | 29/157 |
| 3,972,440 | 8/1976 | Warren | 220/18 |
| 4,278,115 | 7/1981 | Briles et al. | 141/86 |
| 4,491,147 | 1/1985 | Argandona | 220/18 X |
| 4,520,852 | 6/1985 | Klein | 141/86 |
| 4,527,708 | 7/1985 | Dundas et al. | 220/85 F X |
| 4,570,812 | 2/1986 | Curtis | 220/18 X |

*Primary Examiner*—Steven M. Pollard

*Attorney, Agent, or Firm*—Price, Heneveld, Cooper, DeWitt & Litton

[57] ABSTRACT

A spill control device for underground liquid storage tanks having an upwardly extending fill pipe. The control device comprises a steel, epoxy coated, liquid collecting spill tank having a riser tube that extends upward through the tank bottom. A circular seal ring fits about the upper end of the riser tube and about the outer wall of a fill pipe received through the riser tube. A clamp compresses the seal about both the riser tube and fill pipe. A liquid impermeable cover is provided which covers the access opening in the top of the spill tank. A first basin surrounds the cover for channeling precipitation, and other liquids impinging the cover, away from the spill tank. A valve is disposed on the fill pipe for selectively directing liquids discharged into the spill tank into the storage tank. A second basin surrounds the spill tank for recovering liquids discharged from the spill tank during a filling operation.

20 Claims, 10 Drawing Figures

LIQUID TANK SPILLAGE CONTROL SYSTEM

The present application is a continuation of prior application Ser. No. 862,050, filed May 12, 1986 entitled LIQUID TANK SPILLAGE CONTROL SYSTEM, now abandoned, which is a continuation-in-part of prior application Ser. No. 738,592 filed May 28, 1985, now abandoned, which is a continuation-in-part of prior application Ser. No. 610,265 filed May 14, 1984, now U.S. Pat. No. 4,527,708.

BACKGROUND OF THE INVENTION

The present invention relates to systems for underground liquid storage tanks to control spillage during filling of the tank, and in particular to spillage containment vessels for use with such underground tanks.

Underground storage tanks used in the storage of toxic or flammable liquids, such as those used for storage of petroleum products at service stations and the like, normally include a casing or fill pipe that runs from the subsurface tank up to the ground surface. A manhole surrounds the upper end of the casing in order to access the casing and provide clearance for a valve used to connect delivery truck fill hoses to the casing. Although most liquid product delivery trucks are equipped with a shutoff valve that stop liquid flow to the fill hose when a storage tank is full, spillage of product is common when filling such tanks. Spills normally occur due to leakage at the fill pipe-hose coupling or by the discharge of the standing liquid within the truck hose. Even though the truck's shutoff valve halts delivery to the base, the truck hose remains filled with liquid product. When the hose is disconnected from the casing, this remaining liquid runs out onto the ground.

The contamination produced by such liquid storage tank spills results in a substantial health hazard. When toxic or flammable liquids, such as gasoline, diesel fuel or the like are dumped onto the ground, these products may enter the local ground water or otherwise enter into the ecosystem. Even if the spillage is not absorbed into the ground but is drained off into a sewage system, a toxic or explosive atmosphere can be produced within the local sewer system.

The severity of contamination due to underground liquid storage tank spillage is evidenced by the fact that various state and local governments are enacting legislation to require systems for controlling such spills. Although various methods may be utilized on tanks installed in the future, the problem remains with the numerous previously installed underground storage tanks presently in use.

In the spill containment system disclosed in the aforementioned patent, water due to precipitation and/or other liquids and chemicals used to wash pavement often drained into the containment vessel when the vessel was mounted flush with grade. This problem is encountered in the typical gas station installation where, for example, the pavement is often periodically cleaned with a degreasing agent and water. This is undesirable because it lowers the capacity of the containment system to absorb spills and it contaminates the liquids spilled therein with water. The latter problem makes recovery of the liquid spilled for useful purposes quite difficult.

SUMMARY OF THE INVENTION

The present invention solves the problems associated with product spillage during the filling of a main underground liquid storage tank by the provision of a liquid impermeable containment vessel that is located at the top of tha tank fill pipe. The fill pipe extends up through the bottom of the containment vessel, and the bottom of the vessel is sealed about the fill pipe in order to prevent the passage of liquid product therethrough. Since the containment vessel is situated about the upper end of the storage tank fill pipe, any leakage about the fill hose pipe coupling or back flow from the fill hose will be captured within the containment vessel. The liquid product is thus prevented from being dumped onto the ground or entering into a local sewer system.

According to the present invention, the problems associated with precipitation and other liquids draining into the containment vessel are solved by provision of a substantially liquid impermeable cover extending over an access opening in the top of the containment vessel. A first automatic drain basin is also provided which at least partially surrounds the containment vessel and the cover for channeling liquids impinging the cover away from the containment vessel. The drain basin directs these liquids down the side of the containment vessel, and in the case of a below-ground installation, into the soil beneath the pavement where these liquids percolate away from the vessel. This arrangement successfully diverts precipitation encountered in above-ground installations and other liquids such as wash water and the like often encountered in installations flush with grade.

According to another aspect of the invention, a valve is provided on the portion of the fill pipe extending into the containment vessel. The valve is used for selectively draining liquids spilled in the containment vessel into the storage vessel to recover the same. Still further, in another embodiment of the invention, a second basin is disposed about the containment vessel between the first basin and the vessel and disposed under the cover, for recovering liquids spilled from the containment vessel and automatically channeling the same to a secondary recovery storage tank.

According to still another aspect of the invention, the liquid containment vessel is provided with an internal riser tube and a coupling that seals the riser tube to a liquid storage tank fill pipe. Preferably, this coupling includes a removable flexible seal that extends about both the riser tube and fill pipe and a clamp element that clamps the seal between the fill pipe and the tank providing for a limited amount of relative movement between the riser tube and the fill pipe. This facilitates flush installation of the spill containment system of the present invention in a parking lot, or the like, without transmitting damaging loads to the fill pipe or the main underground storage tank.

These and other aspects or features of the invention will be apparent to one skilled in the art from the specification, claims and drawings appended hereto.

BRIEF DESCRIPTION OF THE DRAWINGS

in FIG. 7, the spill control device is illustrated in an above-ground installation;

in FIG. 8 the spill control device is illustrated in a below-ground installation flush with grade;

DETAILED DESCRIPTION OF THE PREFERRED EMBODIMENTS

Figure 1:
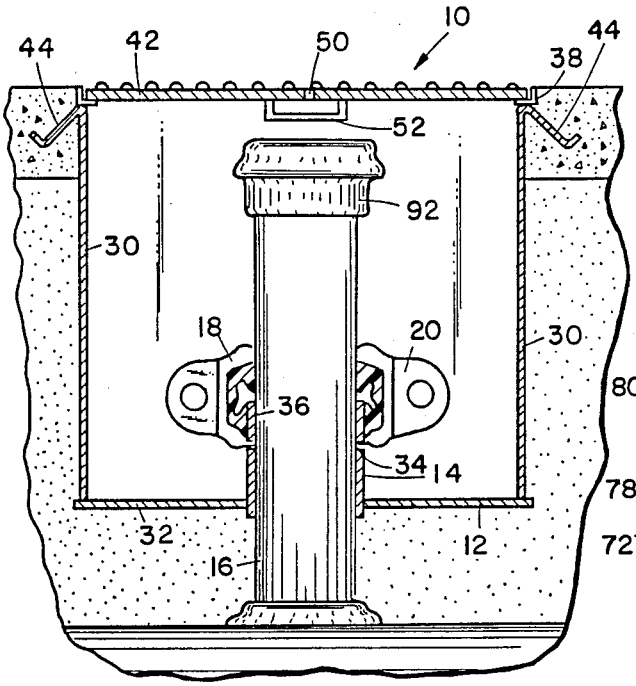
FIG. 1 is a front elevational, sectional view of a spill control device embodying the present invention installed upon the fill pipe of an underground liquid storage tank, with only a portion of the tank being shown.
Figure 2:
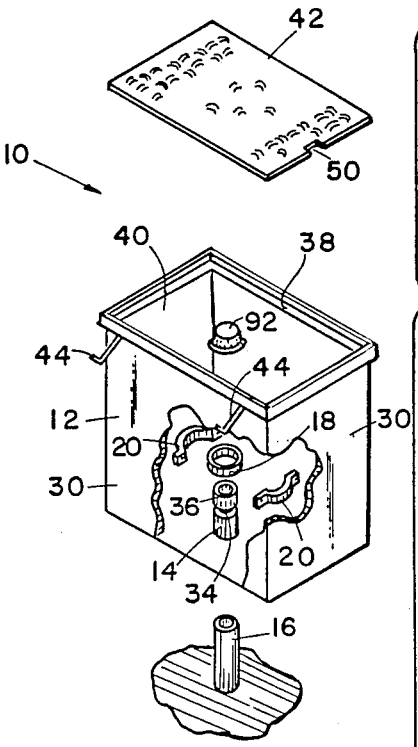
FIG. 2 is an exploded, perspective view of the spill control device shown in FIG. 1, with a portion of the containment vessel partially broken away.

A spill control system or device for underground liquid storage tanks is illustrated in FIGS. 1 and 2 and designated generally by the reference number 10. Spill control device 10 includes a containment tank 12 that has a short, cylindrical riser tube 14 that is mounted on the bottom of tank 12. A conventional liquid storage tank fill pipe 16 is received through riser tube 14 so that the tank 12 can be buried flush with the ground surface. A seal ring 18 encircles the joint between riser tube 14 and fill pipe 16 while a pair of clamp brackets 20 clamp about both riser tube 14 and fill pipe 16 in order to compress seal 18 in place. Containment tank 12 operates to capture any liquid that is spilled during the filling of the storage tank.

As illustrated herein, containment tank 12 is a vessel formed by four sidewalls 30 that are welded or otherwise suitably joined to a bottom 32 to form a rectangular box. Riser tube 14 passes upward through bottom 32 and is welded thereto. Space slightly beneath the top edge of riser tube 14 is an annular channel or groove 34 that extends in a ring about the outer surface of riser tube 14. Channel 34 forms a seat for clamp brackets 20 and also defines a seal contact surface 36 above channel 34. Extending continuously about the upper perimeter on top of sidewalls 30 is a right angle flange or L-shaped seating bracket 38 that defines a rectangular access opening 40 (FIG. 2) through the top of tank 12. Seating bracket 38 is used to seat a cover or closure member 42 in access opening 40. Depending at an outwardly, downwardly sloping angle from bracket 38 are four "L"-shaped pavement anchors. Anchors 44 are used to anchor tank 12 within the pavement or ground surface with bracket 38 flush therewith, so that frost or ground movement will not raise tank 12 above the surrounding pavement.

Preferably, tank 10 is made of steel sheet ten gauge thick. Tank bottom 32 is a rectangular shape sixteen inches wide by eighteen inches long. Sidewalls 30 with seat bracket 38 are eighteen and one-half inches high, while riser tube 14 extends three inches above bottom 32. Tank 12 therefore has a capacity of over twenty gallons. Riser tube 14 has an inside diameter that is determined by the outside diameter of the particular fill pipe 16 device 10 is to be used with. Although riser tube 14 closely receives pipe 16 in order to permit seal 18 to bridge the joint between tube 14 and pipe 16, riser tube 14 provides enough clearance to accommodate some misalignment of pipe 16.

Tank 12 and riser tube 14, are coated on both the interior and exterior with an epoxy coating to prevent corrosion of tank 12. A suitable epoxy coating is one sold by Koppers Company, Inc. under the trade designation Bitumastic 300M Coal Tar Epoxy. Alternatively, tank 12 may be made from stainless steel, fiberglass or other corrosion resistant materials.

Alternatively, tank 12 may be cylindrically shaped rather than a rectangular box. In the alternative cylindrical embodiment, bottom 32 is preferably eighteen inches in diameter while sidewalls 30 are eighteen inches high. Seat bracket 38 increases the height of sidewalls 30 by one-half inch to give tank 12 an overall height of eighteen and one-half inches.

Cover 42 is a flat rectangular plate dimensioned to fit within seat bracket 38. Cover 42 includes raised lugs on its upper surface to provide a conventional traction surface. Cover 42 is normally three-eighths of an inch thick so that cover 42 will seat beneath the upper edge of seat bracket 38. Since cover 42 is recessed, objects will not strike or catch and inadvertently lift cover 42. A rectangular notch 50 is cut on one side of the cover 42 to provide a removal aperture in which a tool can be inserted in order to lift the cover. Depending from the underside of cover 42 adjacent notch 50 is a bent metal handle 52. Handle 52 is used to pick up cover 42 once it has been raised using notch 50.

Figure 4:
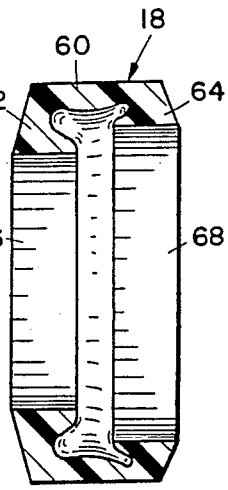
FIG. 4 is a sectional view of the seal element used with the clamp element shown in FIG. 3, the seal element being turned on its side.

Seal 18 shown in FIG. 4 is a generally circular ring having an outer wall 60. An upper flange 62 and a lower flange 64 extend radially inward from outer wall 60 and define an upper aperture 66 and a lower aperture 68 respectively. Upper flange 62 extends inward further than lower flange 64 so that upper aperture 66 has a diameter small than that of lower aperture 68. Lower aperture 68 is provided with a diameter which creates a snug fit about riser tube 14 on seal contact surface 36. Similarly, upper aperture 6 has a diameter which provides a snug fit about fill pipe 16 just above the top edge of riser tube 14. Seal wall 60 is therefore tall enough to span the gap between riser tube 14 and fill pipe 16, while the different diameters of upper and lower apertures 66, 68 provide a tight seal simultaneously about the different diameters of riser tube 14 and fill pipe 16. The inner free edge of both upper flange 62 and lower flange 64 widen out to form enlarged vertical sealing surfaces that are deformable to provide a tight seal about the entire tube or pipe circumference. Preferably, seal 18 is formed from a rubber or polymeric material that is unaffected by petroleum products. Most preferably, seal 18 is made from a Buna N rubber material so that gasoline or other petroleum products will not deteriorate the seal.

Figure 3:
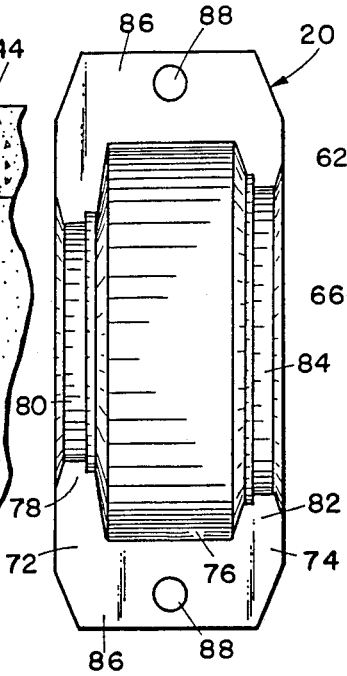
FIG. 3 is a front elevational view of a clamp section used in the spill control device of FIG. 1, the clamp section being turned on its side.
Figure 5:
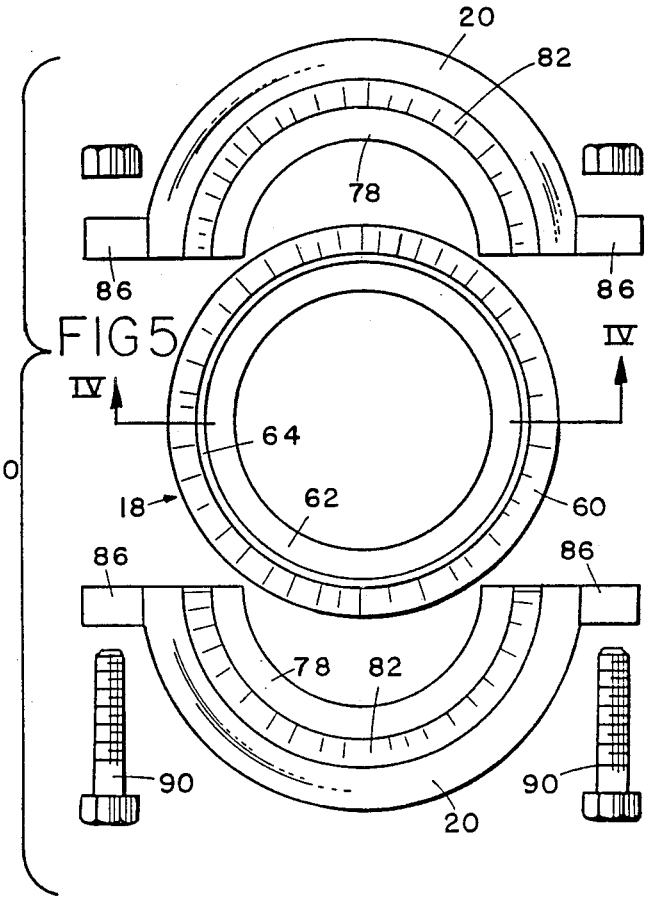
FIG. 5 is a bottom plan view of two clamp elements as shown in FIG. 3 and the seal element of FIG. 4, shown with the clamp elements in an unclamped condition.

As shown in FIG. 3, each clamp bracket 20 is provided with a semi-circular or "C"-shape which extends around half of seal 18. Each clamp bracket has an upper flange 72 and a lower flange 74 that extend radially inward to define a seal seat area 76 therebetween. Seal seat area 76 is a generally trapezoidal-shaped recess within which the seal sidewall 60 is disposed with a snug fit. Extending inward from upper flange 72 is an upper clamp lip 78 that forms an upper aperture 80 when two clamp halves 20 are joined together. Similarly, the inner free end of lower flange 74 has an inwardly extending lower clamp lip 82 that defines a lower aperture 84 when two clamp brackets 20 are joined together The radius of lower clamp aperture 84 is approximately equal to the inner radius of riser tube channel 34. Lower clamp lip 82 will therefore seat solidly within channel 34 when two clamp brackets 20 are joined together about channel 34. Similarly, the radius of upper aperture 80 is approximately equal to the outer radius of fill pipe 16 so that upper lip 78 will seat solidly against the outer wall of fill pipe 16. When seal 18 is seated in seat area 76 clamp upper flange 72 and lower flange 74 extend inward less than seal upper flange 62 and lower flange 64, respectively. Seal upper flange 62 and lower flange 64 therefore protrude into the apertures formed between clamp brackets 20. This protrusion of upper and lower flanges 62, 64 provide for compression of seal 18 about the riser 14 and the fill pipe 16. Extending radially outward from either side of bracket 20 is a flat connecting flange or ear 86 having a bolt aperture 88 therethrough. A pair of bolts 90, FIG. 5, pass through apertures 88 and secure clamp brackets 20 together.

Fill pipe 16 is a conventional fill pipe for an underground liquid storage tank. Fill pipe 16 extends upward from the tank and terminates a short distance beneath the ground surface. A threaded cap 92 is used to close pipe 16 when the storage tank is not being filled. Normally, the fill pipe 16 is welded or provided with a threaded connection to the underground storage tank. The seal design of the present invention provides for some relative movement between the fill pipe and the containment vessel which greatly reduces the loads imposed on the fill pipe and the storage tank when the containment vessel is flush mounted in pavement which is used by vehicular traffic.

Figure 6:
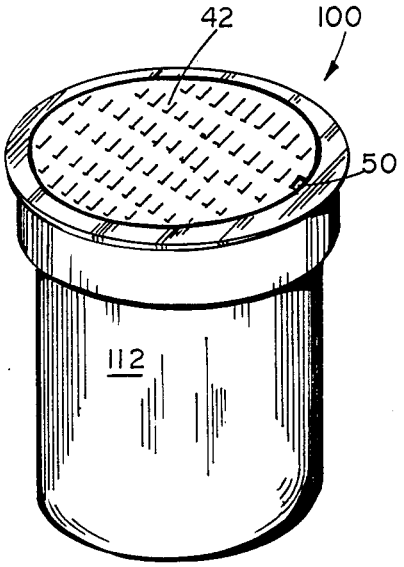
FIG. 6 is a perspective view of another embodiment of the spill control device of the present invention.
Figure 7:
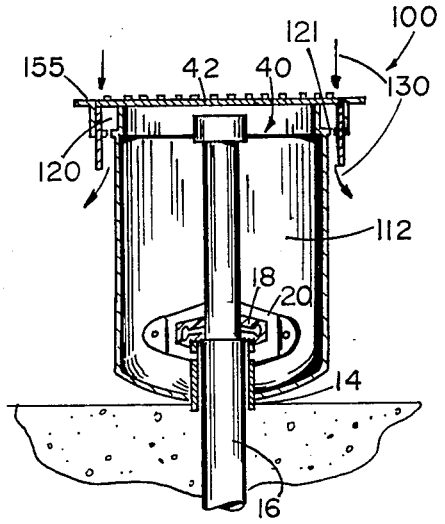
FIG. 7 is a front elevational view, partially in section, of the spill control device illustrated in FIG. 6.
Figure 8:
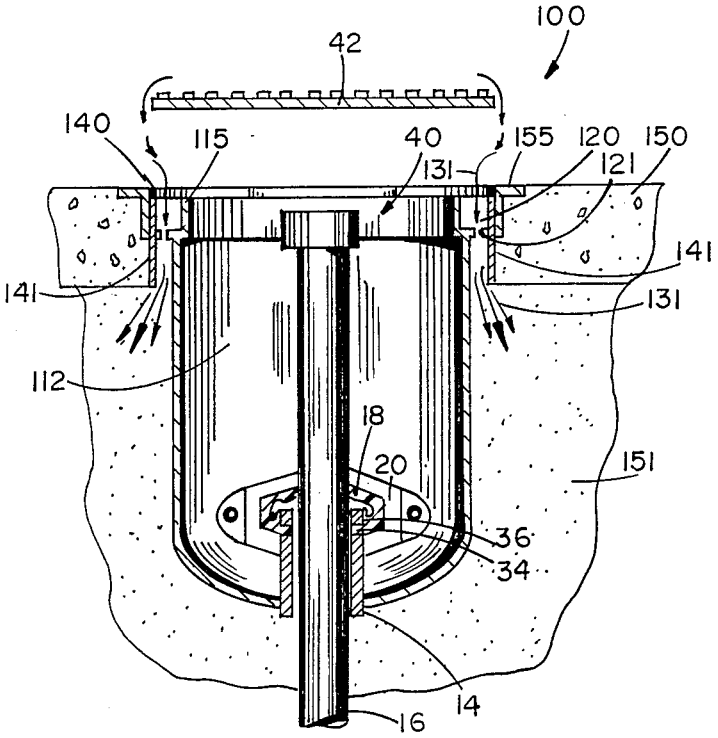
FIG. 8 is a front elevational view, partially in section, and partially exploded, of the spill control device illustrated in FIG. 6.

With reference now to FIG. 6, the improved spill containment device of the present application is generally illustrated at 100. The improved spill containment device 100 is substantially the same as the device 10 previous described and like components are given the same numeral designation. The principal difference between the improved containment device 100 and that previously described resides in the provision of an arrangement for isolating the containment vessel from precipitation, wash liquids, or the like, which impinge the cover of the device. It will also be noted that the improved device 100 is illustrated in a cylindrical configuration while the previous device 10 is illustrated in a rectangular configuration. With specific reference now to FIGS. 6-8, the improved spill control device 100 includes a cylindrical containment tank 112. The containment tank 112 includes a short cylindrical riser tube 14 which is mounted on the bottom of the tank. A conventional liquid storage tank fill pipe 16 is received through the riser tube 14 so that the containment vessel 112 can be mounted in an above-ground installation as illustrated in FIG. 7, or in a below-ground installation as illustrated in FIG. 8. An elastomeric seal ring 18 encircles the joint between the riser tube 14 and fill pipe 16 while a pair of clamp brackets 20 clamp about both the riser tube 14 and the fill pipe 16 to compress the seal 18 in place. The containment tank or vessel 112 operates in the same fashion as the vessel 12 previously described with respect to the collection of fluids expelled from the fill pipe 16.

The containment vessel 112 further includes a substantially liquid impermeable cover 42 which extends over and substantially covers the access opening 40 in the top of the containment vessel. According to the present invention, it is important that the cover 42 extend over and substantially encompass the top edge 115 of the vessel 112 which defines the periphery of the access opening 40. Further, a first basin is provided at 120 which at least partially surrounds the containment vessel 112 and the cover 42. In this case, the basin 120 is annular in shape and surrounds the top edge 115 of the containment vessel 112. This arrangement collects precipitation and other liquids impinging upon the top surface of the cover 42 and channels them away from the access opening 40 when they drain around the periphery of the cover 42. The basin 120 preferably includes an open bottom or a plurality of apertures 121 disposed in the bottom thereof for exhausting the liquids collecting therein down the sides of the containment vessel 112, as illustrated by the arrows 130 in FIG. 7, or into the ground surrounding the containment vessel 112, as illustrated by the arrows 131 in FIG. 8, where these liquids are permitted to percolate away from the containment vessel.

With specific reference now to FIG. 8, it is illustrated that the cover 42 preferably rests on a shoulder defined by one or both of the top surface 115 of the containment vessel 112 and the surface 140 of a concrete skirt 141. Although the cover 42 may rest on one or the other or both of the shoulders 115 and 140, what is important is that the basin 120 is below and in fluid communication with either of the shoulders 115 and 140. Thus, liquids draining around the periphery of the cover 42 or through the notch 50 in the cover 42 (best illustrated in FIG. 6) are automatically trapped in the basin 120 and drained away from the interior of the containment vessel 112. The concrete skirt 141 extends along the sides of the containment vessel 112 a suitable length for preventing concrete or pavement 150 from engaging the exterior of the containment vessel 112 and sealing the liquids within basin 120. In below-ground installations, with the top of the containment vessel mounted flush with grade, as illustrated in FIG. 8, this insures that the basin 120 is in fluid communication with the soil 151 disposed under the pavement 150 so that liquids collected therein are automatically directed to the soil 151 where they percolate away from the containment vessel 112. Preferably, the basin 120, the concrete skirt 141, and the surrounding angular flange 155 are of welded steel construction.

Figure 9:
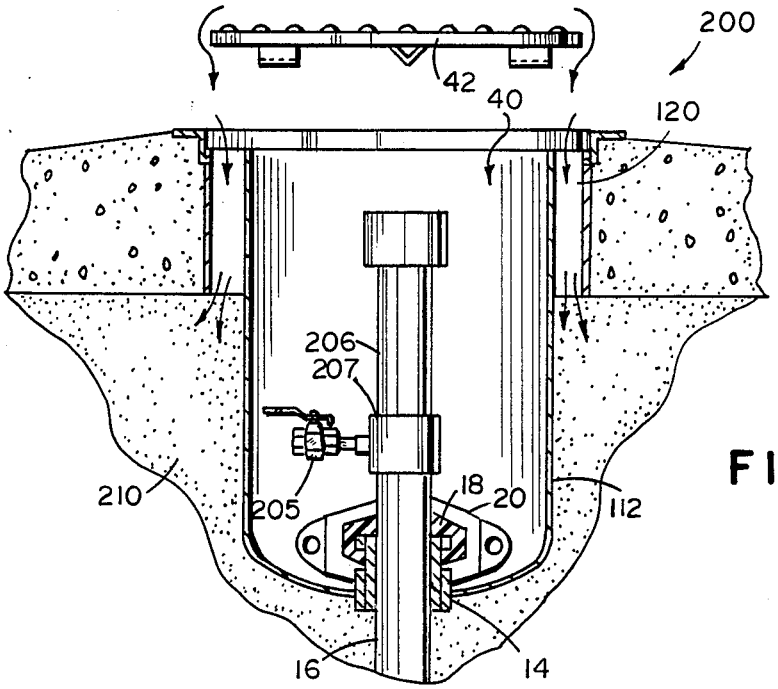
FIG. 9 is a front elevational view, partially in section and partially exploded, of another embodiment of the spill control device of the present invention.

With reference now to FIG. 9, another embodiment of the improved spill containment device of the present invention is generally illustrated at 200. This embodiment of the invention shares many components with those previously described and like components are given the same numeral designation. The principal difference between the containment device of FIG. 9 and those previously illustrated is the provision of a valve 205 on a portion of the fill pipe 206 which extends into the containment vessel 112. The valve 205 is mounted in a threaded connector 207. The connector 207 is mounted in a section of the fill pipe 206 which extends into the containment vessel by cutting the same at a point above the clamp 20 and threading the ends of the fill pipe which are then inserted in the threaded connector 206. This places the valve 205 in fluid communication with the interior of the upstanding fill pipe so that the valve can be used for selectively draining liquid spilled into the containment vessel 112 into the main storage vessel therebelow for recovery of the liquid. Thus, for example, when a substantial amount of clean petroleum product is spilled within the containment vessel 112, the operator may choose to recover the same by actuating the valve 205 and draining the spilled product into the main storage tank. This, of course, is facilitated by the fact that the containment vessel 112 is itself protected from contamination from the surrounding environment by the substantially impermeable cover 42 and the first basin 120 which surrounds the edge of the cover 42 for channeling away water and other liquids impinging upon the cover. Also, as best illustrated in FIGS. 9 and 10, it may also be desirable in soils which do not percolate water well to surround the containment vessel 112 with the body of gravel 210 to assist in the drainage of water and other fluids through the basin 120.

Figure 10:
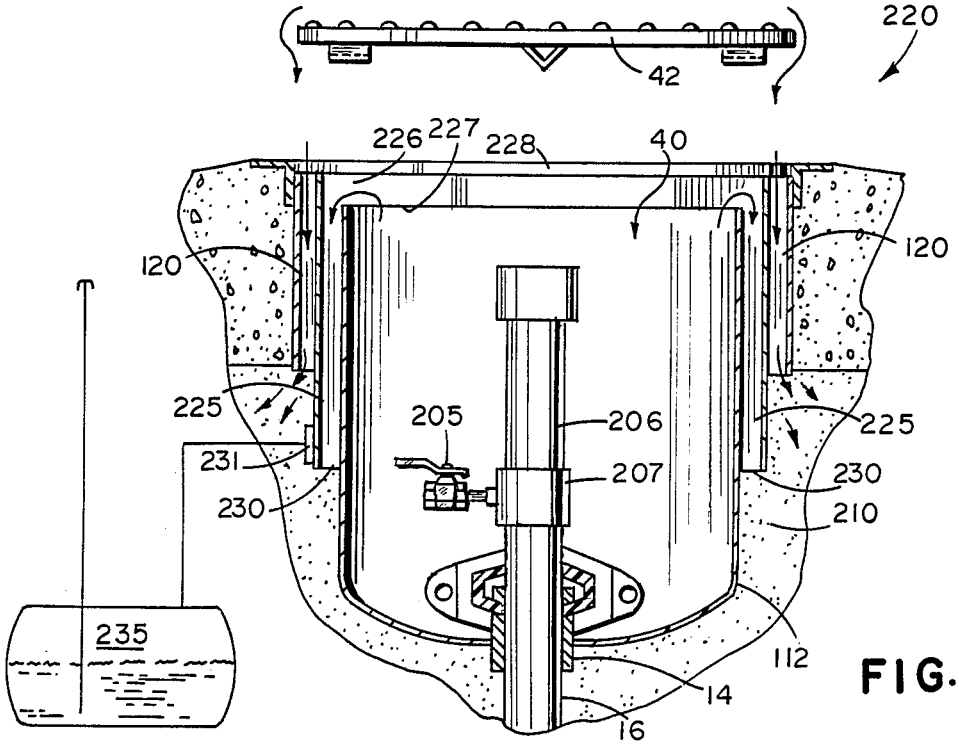
FIG. 10 is a front elevational view, partially in section and partially exploded, of another embodiment of the spill control device of the present invention.

With specific reference now to FIG. 10, still another embodiment of the improved spill containment system of the present invention, is illustrated at 220. Again, this embodiment of the invention shares many components with the previous embodiments and like components are given the same numeral designation. The principal difference between the containment device 220, illustrated in FIG. 10, and those previously disclosed, relates to the provision of a second basin 225 disposed about the containment vessel 112 between the first basin 120 and the vessel 112. Preferably, the second basin 225 is disposed under the peripheral edge of the substantially liquid impermeable cover 42 and an annular clearance 226 is provided between the top edge 227 of the containment vessel 112 and the annular support shoulder 228 for the cover 112 to place the containment vessel 112 in fluid communication with the second basin 225. The second basin 225 is not open to the environment, but rather is provided with a closed bottom 230 and an outlet at 231 for directing fluids spilled over the top edge 227 of the containment vessel 112 to a secondary recovery tank 235. The first basin 120 in this embodiment of the invention operates in a substantially identical manner to the basin 120 disclosed in previous embodiments in that water or other liquids impinging upon the top surface of the substantially liquid impermeable cover 42 are channeled away from the containment vessel 112 and the second basin 225 into the surrounding strata to percolate away from the containment vessel. However, with the provision of the second basin 225, large spills which fill the containment vessel 112 are not released to the environment but rather are channeled away for automatic recovery by the second basin 225.

ASSEMBLY

In order to assemble spill control device 10, the ground surrounding the upper end of fill pipe 16 is excavated and any conventional manholes or the like are removed. Tank 12 is fitted down over fill pipe 16, with fill pipe 16 being readily received up through riser tube 14. When seat bracket 38 is located flush with the surrounding ground, surface tank 12 is clamped to fill pipe 16. Seal 18 is fitted over the upper end of riser tube 16 and slid downwardly until lower seal flange 64 is received over riser tube 14 and seated on contact surface 36. A suitable lubricant may be used in order to assist in sliding seal 18 down riser tube 16. Clamp brackets 20 are then fitted about seal 18, with seal 18 being received in seat area 76. Bolts 90 are tightened in connecting flanges 86 in order to compress seal 18 about the joint between riser tube 14 and fill pipe 16. When fully tightened, lower clamp lip 82 is solidly seated in riser tube channel 34 and upper clamp lip 78 contacts riser tube 16. Riser tube 14 accommodates small deviations of fill pipe 16 from the vertical due to its inner diameter being greater than that of fill pipe 16. Once clamped in position, the excess excavation is filled in and pavement is patched around tank 12. Anchors 44 are set in the surrounding pavement and insure that tank 12 remains flush with the ground surface.

It is to be understood that the above is merely a description of the preferred embodiment. It will be apparent to those who make and use the invention that various modifications or improvements may be made without departing from the spirit of the invention herein. The scope of the protection afforded is to be determined by the claims which follow and the breadth of interpretation which the law allows.

The embodiments of the invention in which an exclusive property or privilege is claimed are defined as follows:

1. A spill control device for underground liquid storage tanks used in the storage of toxic or flammable materials, comprising:

a liquid impermeable spill collecting tank having a top and a bottom, said top having an access opening thereat that provides sufficient clearance for the passage of a fill hose therethrough, said tank having a pipe aperture through said bottom of a dimension sufficient to provide the close reception of a liquid storage tank fill pipe therethrough;

means for sealing said tank bottom about a liquid storage tank fill pipe received through said pipe aperture to prevent fluid passage through said pipe aperture, whereby said tank forms a liquid impermeable container about the upper end of a liquid storage tank fill pipe when assembled thereon to prevent liquid contaminants from entering the ground surrounding said pipe;

a substantially liquid impermeable cover adapted for extending over and substantially covering said access opening; and a first basin at least partially surrounding said spill collecting tank and said liquid impermeable cover for channeling liquids impinging said cover away from said spill collecting tank.

2. The spill control device of claim 1 further comprising a second basin at least partially surrounding said spill collecting tank and disposed under said liquid impermeable cover for recovering fluids spilled in said spill collecting tank and overflowing into said second basin.

3. The spill control device of claim 2 wherein said spill collecting tank is provided with a top edge which is disposed below said liquid impermeable cover for providing an opening through which fluids overflowing said spill collecting tank pass into said second basin for recovery.

4. The spill control device of claim 2 wherein said second basin comprises a secondary containment vessel with a fluid outlet disposed proximate the bottom thereof for draining said second basin.

5. The spill control device of claim 4 further comprising a secondary recovery storage vessel connected to said fluid outlet for collecting and storing recovered fluids draining from said second basin.

6. The spill control device of claim 1 further comprising a valve and means for mounting said valve in a portion of said fill pipe which extends into said containment vessel for recovering fluids spilled in said containment vessel by selectively opening said valve and directing the spilled fluid into said fill pipe.

7. The spill control device of claim 1 wherein said top of said spill collecting tank is provided with a shoulder for supporting said liquid impermeable cover and said first basin is disposed below and in fluid communication with said shoulder.

8. The spill control device of claim 1 wherein said first basin is provided with a plurality of apertures proximate the bottom thereof for channeling liquids down the side of said spill collecting tank.

9. The spill control device of claim 1 wherein said spill collecting tank is adapted for mounting flush with grade and a skirt is provided which surrounds and extends below the bottom of said basin.

10. The spill control device of claim 1 wherein: said sealing means includes a seal element having an inner seal area for receipt of a fill pipe therethrough;

means for clamping said seal to a fill pipe received through said access opening and for clamping said seal to said tank.

11. The spill control device of claim 10 further comprising:

a containment pipe extending upwardly from said tank bottom and communicative therethrough, said clamping means clamping said seal element to said containment pipe.

12. The spill control device of claim 11, wherein:

said clamp means has an upper lip defining an upper opening and a lower lip defining a lower opening larger than said upper opening, said lower lip extending about said containment pipe and said upper lip disposed to extend about a fill pipe received through said containment pipe.

13. The spill control device of claim 12 wherein:

said containment pipe includes a clamp channel extending about its upper end, said clamping means lower lip being seated in said clamp channel.

14. The spill control device of claim 13 wherein:

said clamp channel is spaced beneath the top edge of said containment pipe and defines a seal seating surface between said clamp channel and said fill pipe top edge.

15. The spill control device of claim 14 wherein:

said seal element is a ring having an upper flange defining an upper seal aperture and a lower flange defining a lower seal aperture larger than said upper seal aperture, said lower seal flange extending about said containment pipe and said upper seal flange disposed to extend about a fill pipe received through said containment pipe.

16. The spill control device of claim 11 wherein:

said seal element is a continuous ring having an upper flange defining an upper seal aperture and a lower flange defining a lower seal aperture larger than said upper seal aperture, said lower seal flange extending about said containment pipe and said upper seal flange disposed to extend about a fill pipe received through said containment pipe.

17. The spill control device of claim 16 wherein:

said clamping means including a seal seat recess, said seal element being received in said seal seat recess so as to be encased by said clamping means when clamped to said containment pipe.

18. The spill control device of claim 1 wherein:

said tank is coated with an epoxy material.

19. A spill control device for underground liquid storage tanks used in the storage of toxic or flammable materials comprising:

a liquid impermeable containment vessel having an upper opening, a bottom surface and a riser tube extending upwardly from said bottom surface, said riser tube having an inner diameter sufficient to receive a liquid storage tank fill pipe therethrough;

a liquid impermeable coupling having means for connecting said riser tube to a fill pipe received through said riser tube and for preventing the passage of liquid between said riser tube and said fill pipe;

a substantially liquid impermeable cover adapted for extending over and substantially covering said upper opening; and a basin at least partially surrounding said containment vessel for channeling liquids away from said containment vessel.

20. A kit for assembling a spill control device for underground liquid storage tanks used in the storage of toxic or flammable materials, comprising:

a liquid spill collecting tank having a top, sides and a bottom, said tank having an access opening in the top thereof, said tank having a riser tube extending upwardly from said bottom, said riser tube having an aperture therethrough dimensioned to receive a liquid storage tank fill pipe therein;

a circular seal element dimensioned to be received over and seal against the upper end of said riser tube, said seal element having an inner sealing surface to contact and seal against a liquid storage tank fill pipe received through said riser tube;

a clamp having a seal seat dimensioned to receive said seal element therein and having a lower end dimensioned to clamp said seal to said riser tube, said clamp having an upper end dimensioned to clamp said seal to a fill pipe received through said seat, whereby said tank, seal element and clamp may be assembled onto a liquid storage tank fill pipe in order to provide a liquid impermeable containment vessel about the upper end of said riser tube;

a substantially liquid impermeable cover adapted for extending over and substantially covering said access opening; and a basin at least partially surrounding said spill collecting tank for channeling liquids away from said spill collecting tank.

* * * * *